United States Patent [19]

Smith

[11] Patent Number: 4,968,279

[45] Date of Patent: Nov. 6, 1990

[54] INFANT TOY

[76] Inventor: Rosemary Smith, 6122 S. Lima Way, Englewood, Colo. 80111

[21] Appl. No.: 426,663

[22] Filed: Oct. 26, 1989

[51] Int. Cl.[5] ..... A63H 33/00; A47C 20/02

[52] U.S. Cl. ..... 446/071; 446/227; 446/369; 5/437

[58] Field of Search ..... 446/901, 100, 369, 372, 446/72, 73, 227, 71; 5/434, 436, 437, 441, 442, 424, 486

[56] References Cited

U.S. PATENT DOCUMENTS

| | | | |
|---|---|---|---|
| D. 293,754 | 1/1988 | Howell | D6/595 |
| 2,961,668 | 11/1960 | Hayes . | |
| 3,955,314 | 5/1976 | Robb | 446/72 |
| 4,091,481 | 5/1978 | Redman . | |
| 4,197,604 | 4/1980 | Nakamura | 5/437 |
| 4,316,287 | 2/1982 | Rule . | |
| 4,504,240 | 3/1985 | Thomas | 446/100 |
| 4,540,219 | 9/1985 | Klinger | 446/227 X |
| 4,594,072 | 6/1986 | Cowell | 446/227 |
| 4,671,514 | 6/1987 | Wilson-Diehl | 446/901 X |

*Primary Examiner*—Mickey Yu
*Attorney, Agent, or Firm*—Jerry T. Kearns

[57] ABSTRACT

An infant toy is formed from a quilted fabric material stuffed with a cotton batting to form a pillow-like body. The pillow-like body is preferably formed in an ornamental shape and has an open top portion communicating with an interior lined pocket. A plurlaity of hook and loop fastening strips are secured at spaced locations on a front face of the body. A corresponding plurality of fabric patches have cooperating hook and loop fastening members for removably securing the fabric patches to the pillow-like body. The fabric patches are formed in a variety or ornametal shapes and each have a different surface texture. A plurality of elongated tie members each have one end secured to the pillow-like body and are preferably formed in a variety of different surface textures. The toy is designed for the amusement of infants and serves to provide visual and touch sensory stimulation. The toy may be suspended from a crib railing or may be utilized as a pillow.

1 Claim, 4 Drawing Sheets

INFANT TOY

BACKGROUND OF THE INVENTION

1. Field of the Invention

The present invention relates to infant toys, and more particularly pertains to a toY for the amusement of small infants in crib environments which maY also be utilized as a pillow.

2. Description of the Prior Art

Various tYpes of infant toys are known in the prior art. A typical example of such an infant toy is to be found in U.S. Pat. No. 2,961,668, which issued to F. Hayes on Nov. 29, 1960. This patent discloses a stuffed fabric ornamental slumber pillow for use by a child. U.S. Pat. No. 4,091,481, which issued to H. Redman on May 30, 1978, discloses a pillow shaped in a three dimensional tooth-like configuration. U.S. Pat. No. 4,197,604, which issued to M. Nakamura on Apr. 15, 1980, discloses a pillow having an outer fabric sheath stuffed with resilient wadding and configured to resemble an ornamental character. U.S. Pat. No. 4,316,287, which issued to B. Rule on Feb. 23, 1982, discloses a lounging garment adapted for the entertainment of children which includes a fabric envelope having a fanciful contour having arm portions and a head portion so as to resemble an ornamental character. U.S. Design Pat. No. 293,754, which issued to J. Howell on Jan. 19, 1988, discloses a dust cover configured in the shaped of a fish.

While the above mentioned devices are directed to infant toys, none of these devices disclose an infant toy adaptable for use as a suspended crib toy and as an infant pillow. Additionally, none of the aforesaid devices disclose an infant toy having a plurality of removable ornamental patches, each having a different surface texture so as to provide educational touch sensory stimulation to infants. Inasmuch as the art is relatively crowded with respect to these various types of infant toys, it can be appreciated that there is a continuing need for and interest in improvements to such infant toys, and in this respect, the present invention addresses this need and interest.

SUMMARY OF THE INVENTION

In view of the foregoing disadvantages inherent in the known types of infant toys now present in the prior art, the present invention provides an improved infant toy. As such, the general purpose of the present invention, which will be described subsequently in greater detail, is to provide a new and improved infant toy which has all the advantages of the prior art infant toys and none of the disadvantages.

To attain this, a representative embodiment of the concepts of the present invention is illustrated in the drawings and makes use of an infant toy which is formed from a quilted fabric material stuffed with a cotton batting to form a pillow-like body. The pillow-like body is preferably formed in an ornamental shape and has an open top portion communicating with an interior lined pocket. A plurality of hook and loop fastening strips are secured at spaced locations on a front face of the body. A corresponding plurality of fabric patches have cooperating hook and loop fastening members for removably securing the fabric patches to the pillow-like body. The fabric patches are formed in a variety of ornamental shapes and each have a different surface texture. A plurality of elongated tie members each have one end secured to the pillow-like body and are preferably formed in a variety of different surface textures. The toy is designed for the amusement of infants and serves to provide visual and touch sensory stimulation. The toy may be suspended from a crib railing or may be utilized as a pillow.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology emploYed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially those who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved infant toy which has all the advantages of the prior art infant toys and none of the disadvantages.

It is another object of the present invention to provide a new and improved infant toy which may be easily and efficiently manufactured and marketed.

It is a further object of the present invention to provide a new and improved infant toy which is of a durable and reliable construction.

An even further object of the present invention is to provide a new and improved infant toy which is susceptible of a low cost of manufacture with regard to both materials and labor, and which accordingly is then susceptible of low prices of sale to the consuming public, thereby making such infant toys economically available to the buying public.

Still yet another object of the present invention is to provide a new and improved infant toy which provides in the apparatuses and methods of the prior art some of the advantages thereof, while simultaneously overcoming some of the disadvantages normally associated therewith.

Still another object of the present invention is to provide a new and improved infant toy which provides entertainment and sensory stimulation to infants.

Yet another object of the present invention is to provide a new and improved infant toy which may be utilized as a suspended crib toy or as an infant pillow.

Even still another object of the present invention is to provide a new and improved infant toy which utilizes a plurality of removable ornamental patches having various different surface textures to provide amusing and educational sensory stimulation to infants.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
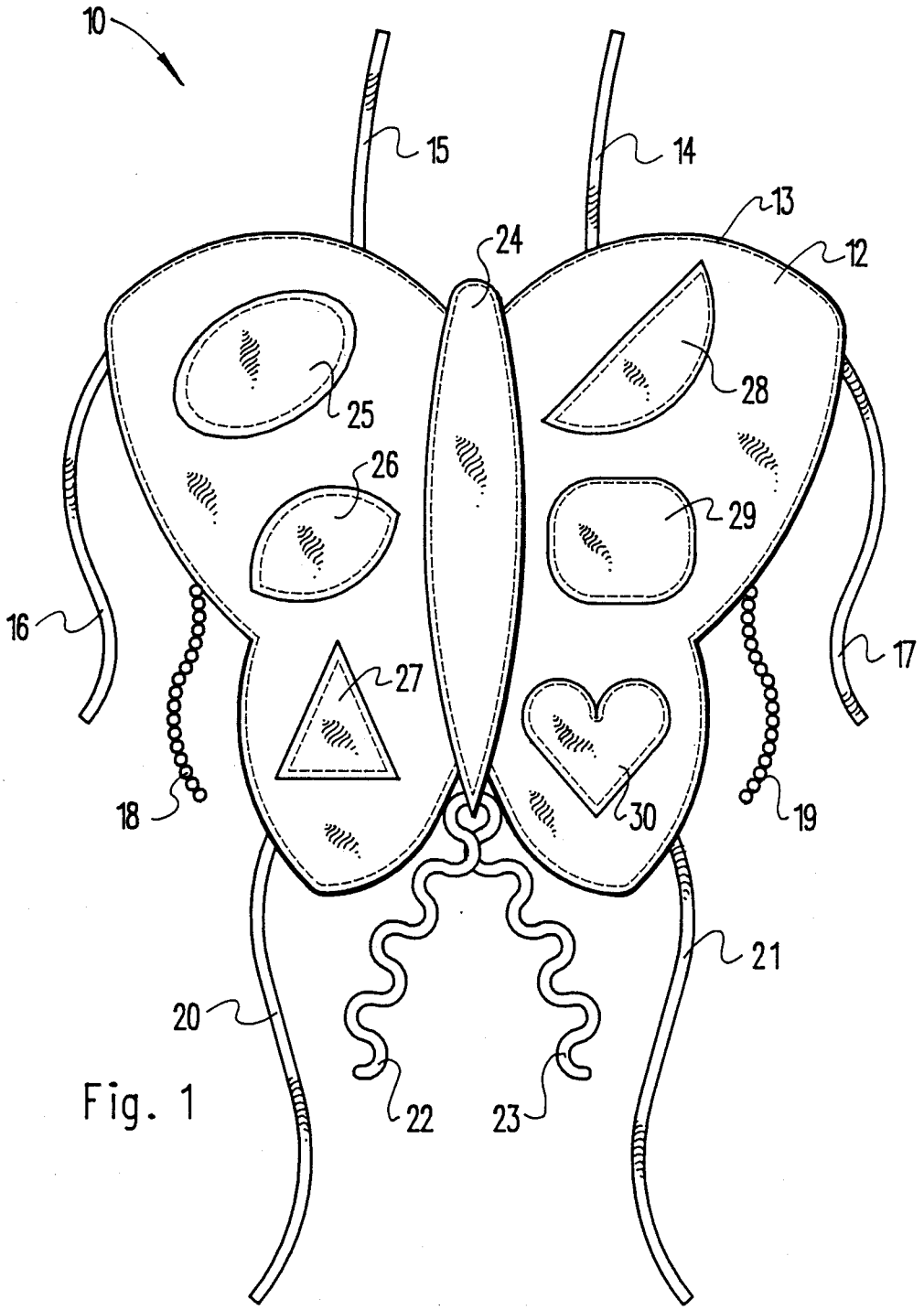
FIG. 1 is a front view of the infant toy of the present invention.

With reference now to the drawings, and in particular to FIG. 1 thereof, a new and improved infant toy embodying the principles and concepts of the present invention and generally designated by the reference numeral 10 will be described.

More specifically, it will be noted that the first embodiment 10 of the invention includes a pillow-like body, the front face 12 of which is illustrated. The pillow-like body is preferably formed from a quilted fabric material stuffed with a cotton batting. A variety of natural and synthetic fibers may be employed, including a foam rubber stuffing material. In any case, it is preferred that the infant toy have a washable construction so as to be susceptible to repeated cleaning and reuse. The pillow-like body is preferably formed in an ornamental configuration, for example the illustrated butterfly shape. The fabric pieces are preferably secured by conventional stitching or seams 13, but may be assembled through the use of adhesive or heat bonding tape. The illustrated front face 12 of the body has a central elongated tapered padded portion 24 which simulates the body portion of a butterfly. The unillustrated opposite back face of the pillow-like body preferably has a smooth contour so as to enable invertible use as a sleeping pillow. A plurality of elongated tie members 14, 15, 16, 17, 18, 19, 20, 21, 22 and 23 each have a first end secured to the body of the toy This securement may be accomplished in a variety of different ways, for example through the use of adhesives, cooperating hook and loop fasteners, or preferably through the use of stitched seams. The various tie members are preferably formed with a variety of different surface textures so as to provide sensory stimulation to an infant. For example, various ribbons, strings, chenille fabric strips, etc. may be employed It should be noted that as a safety consideration, none of the tie members will have a length greater than about 12 inches. In addition to the various different tie members secured to the body, a plurality of various ornamental patches 25, 26, 27, 28, 29 and 30 are removably secured on the front face 12 of the body. This securement is preferably accomplished through the use of cooperating hook and loop type fastening members, for example of the type sold under the trademark VELCRO. Alternative removable fasteners such as snaps, tacky adhesives, etc. may be employed without departing from the scope of the present invention.

Figure 2:
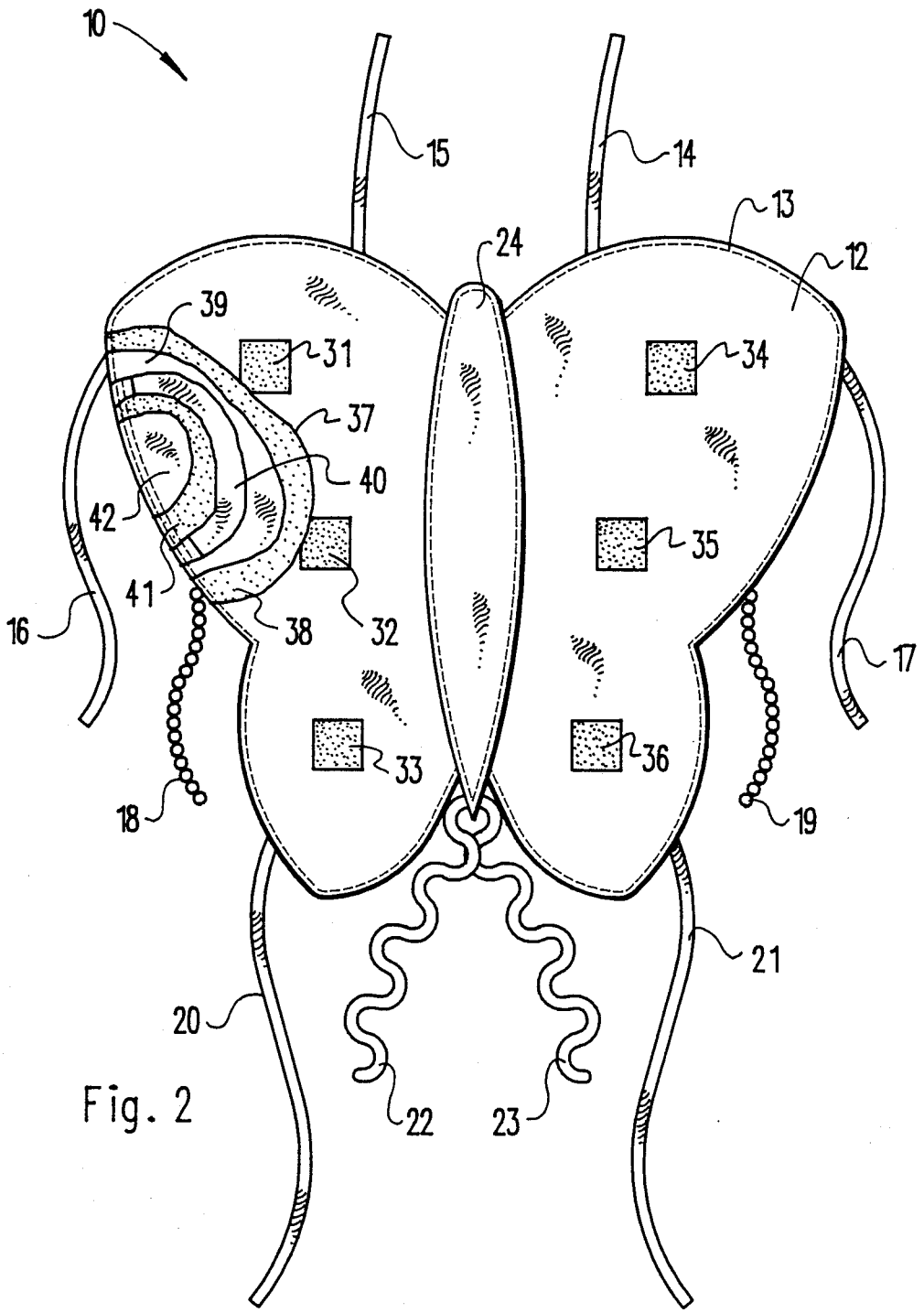
FIG. 2 is a front view of the infant toy of the present invention, having the ornamental patches removed, and partially cut away to illustrate construction detail.

FIG. 2 illustrates the front face 12 of the toy 10 of the present invention, with the various ornamental patches detached to illustrate a plurality of spaced hook and loop type fastening squares or strips 31, 32, 33, 34, 35 and 36. This removable construction allows an infant to remove and handle the various different ornamental patches. Additionally, it is an important feature of the present invention that the various different ornamental and detachable patches are formed with a variety of different surface textures so as to afford a wide range of touch sensory stimulation to an infant. Various different fabrics may be employed to provide a wide range of surface textures. As an important safety feature, the ornamental patches are each formed of a sufficient size so as to preclude the possibility of their being swallowed by an infant. The body portion of the toy 10 has a quilted fabric construction having a first outer fabric layer 37, a next adjacent cotton batting stuffing material 38 and an inner lining material 39. It should be noted that the pillow-like body has an interior lined pocket which may be utilized to receive the various removable ornamental patches so as to play a "hide-and-seek" type game with an infant. The back side face of the body has an outer smooth fabric layer 42 padded by a next adjacent cotton batting layer 41 which is enclosed by an interior fabric material 40.

Figure 3:
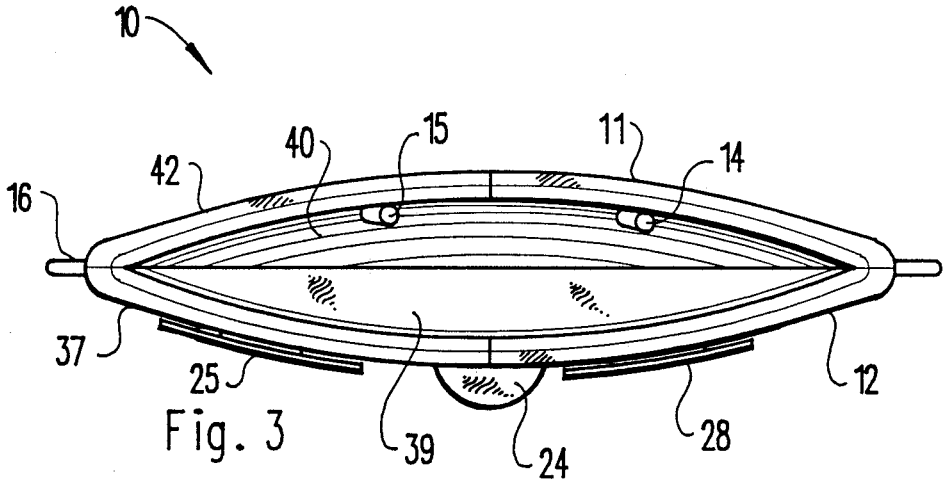
FIG. 3 is a top plan view of the infant toy of the present invention.

As shown in FIG. 3, the body portion of the toy 10 has an open top which communicates with a hollow interior pocket defined by the fabric lining material layers 39 and 40.

Figure 4:
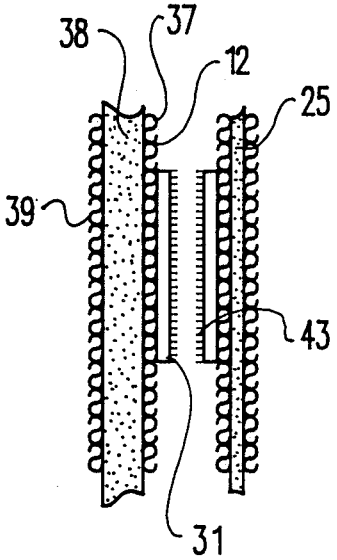
FIG. 4 is a detail view illustrating the use of cooperating hook and loop fastening members for the securement of removable ornamental patches.

FIG. 4 is a detail view which illustrates one of the hook and loop fastening members 31 secured to the fabric layer 37 which constitutes the front face 12 of the pillow-like body. A cooperating hook and loop type fastening member 43 is provided on a back face of each of the patches, for example 25, so as to effect a removable securement.

Figure 5:
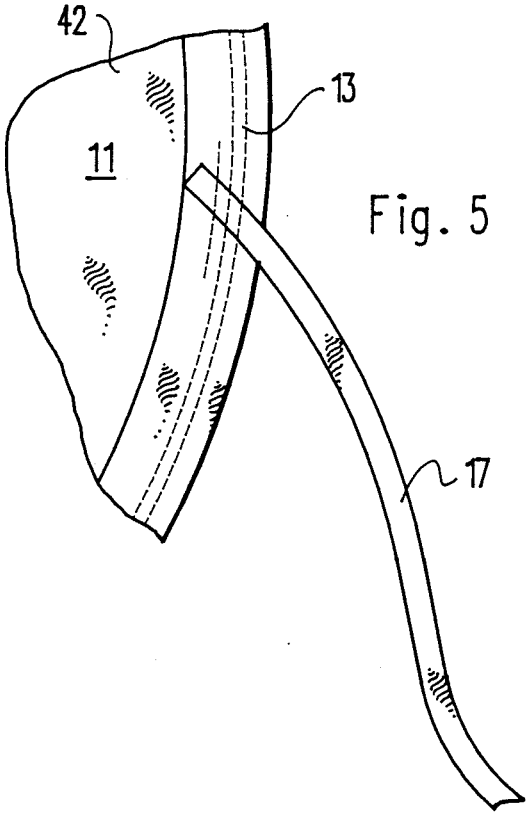
FIG. 5 is a detail view illustrating the manner of securement of an elongated tie member to the body of the infant toy of the present invention.

FIG. 5 illustrates one of the elongated tie member 17 secured by a stitched seam 13 on the back surface 11 of the pillow-like body. The tie 17 may take the form of a fabric ribbon, or a variety of differently textured materials, as previously described. In addition to a permanent stitch securement, the elongated tie members may each be attached by a removable fastening member, for example a snap or a hook and loop type fastener.

Figure 6:
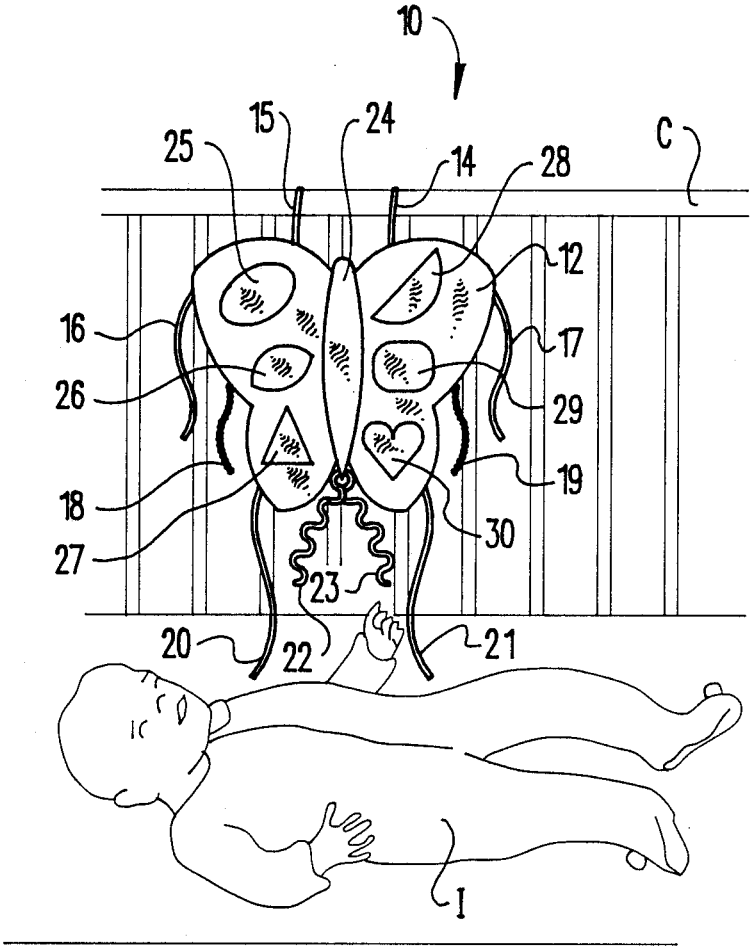
FIG. 6 illustrates an example manner of use of the infant toy of the present invention.

As shown in FIG. 6, the tie members, for example 14 and 15, may be utilized to suspend the toy 10 from the railing of a crib C for the amusement of an infant I. Alternatively, the toy 10 may be utilized as a sleeping pillow, especially because the back surface of the pillow-like body has a smooth uninterrupted surface.

As may now be understood, the present invention provides an infant toy having a dual function as a sleeping pillow and which also provides visual and touch sensory stimulation for the amusement and education of infants and children. The toy of the present invention also provides a vehicle for interaction of an infant with an adult in a "hide-and-seek" type game. To this end, an individual may remove the various ornamental patches and deposit them within the interior pocket through the top opening. The infant may then be encouraged to remove a particular patch, as identified by a blind feeling of its surface texture. The infant toy may also be utilized to play a wide variety of other games as will be readily apparent to those of ordinary skill in the art.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A combination pillow and infant toy, comprising:

a pillow-like body formed from a fabric material and stuffed with a cotton batting;

said pillow-like body having an open top portion communicating with an interior pocket;

at least three first hook and loop fastening members secured at spaced locations on a front surface of said pillow-like body;

at least three fabric patches having various different ornamental shapes, each of said fabric patches having a surface texture which is different from the surface texture of every other fabric patch;

at least three second hook and loop fastening members on said fabric patches configured for engagement with said first hook and loop fastening members;

said interior pocket dimensioned to removably receive said fabric patches;

at least three elongated tie members each having a first end secured to said pillow-like body;

and each of tie members having a surface texture which differs from the surface texture of every other tie member so as to provide a variety of touch sensory stimulation to an infant.

* * * * *